US008356659B2

(12) United States Patent
Zheng et al.

(10) Patent No.: US 8,356,659 B2
(45) Date of Patent: Jan. 22, 2013

(54) AIR CONDITIONER

(75) Inventors: Zhiming Zheng, Osaka (JP); Hiroshi Ohmae, Shiga (JP); Toshihiro Kizawa, Shiga (JP)

(73) Assignee: Daikin Industries, Ltd., Osaka (JP)

( * ) Notice: Subject to any disclaimer, the term of this patent is extended or adjusted under 35 U.S.C. 154(b) by 420 days.

(21) Appl. No.: 12/159,817

(22) PCT Filed: Dec. 25, 2006

(86) PCT No.: PCT/JP2006/325766

§ 371 (c)(1),
(2), (4) Date: Jul. 1, 2008

(87) PCT Pub. No.: WO2007/077789

PCT Pub. Date: Jul. 12, 2007

(65) Prior Publication Data

US 2009/0266524 A1 Oct. 29, 2009

(30) Foreign Application Priority Data

Jan. 4, 2006 (JP) ..... 2006-000154

(51) Int. Cl.

| | |
|---|---|
| ***F28F 19/00*** | (2006.01) |
| ***F28F 13/12*** | (2006.01) |
| ***F25D 23/12*** | (2006.01) |
| ***B01D 59/50*** | (2006.01) |

(52) U.S. Cl. ..... 165/119; 62/263; 55/486; 55/488

(58) Field of Classification Search ..... 165/119, 165/903; 55/486, 488; 62/263
See application file for complete search history.

(56) References Cited

U.S. PATENT DOCUMENTS

| | | | | |
|---|---|---|---|---|
| 3,686,837 | A * | 8/1972 | Hopkins et al. | 55/487 |
| 4,586,349 | A * | 5/1986 | Ohishi | 62/296 |
| 5,379,609 | A * | 1/1995 | Matsumoto et al. | 62/262 |
| 6,312,489 | B1 * | 11/2001 | Ernst et al. | 55/385.3 |
| 7,291,205 | B2 * | 11/2007 | Chu | 96/55 |
| 2005/0241811 | A1 * | 11/2005 | Chin et al. | 165/133 |

FOREIGN PATENT DOCUMENTS

| | | | |
|---|---|---|---|
| JP | S61-079938 | A | 4/1986 |
| JP | H03-181723 | A | 8/1991 |
| JP | H05-049834 | A | 3/1993 |
| JP | 2005-188768 | A | 7/2005 |

* cited by examiner

*Primary Examiner* — Mohammad Ali
*Assistant Examiner* — Daniel C Comings
(74) *Attorney, Agent, or Firm* — Global IP Counselors

(57) ABSTRACT

An air conditioner is disposed with a casing, a filter, an indoor heat exchanger, a blower, and a blowout passage. The casing includes a suction opening and a blowout opening. The filter is disposed downstream of the suction opening and transmits air. The indoor heat exchanger is disposed facing the filter downstream of the filter and performs heat exchange with air that passes through the indoor heat exchanger. The blower is disposed downstream of the indoor heat exchanger and generates a flow of air that is sucked in from the suction opening and is blown out from the blowout opening. The blowout passage includes an air introduction opening disposed facing and downstream of the indoor heat exchanger and guides air from the air introduction opening to the blowout opening. Additionally, the filter has an outer shape that is slanted with respect to the indoor heat exchanger.

7 Claims, 8 Drawing Sheets

AIR CONDITIONER

CROSS-REFERENCE TO RELATED APPLICATIONS

This U.S. National stage application claims priority under 35 U.S.C. §119(a) to Japanese Patent Application No. 2006-000154, filed in Japan on Jan. 4, 2006, the entire contents of which are hereby incorporated herein by reference.

TECHNICAL FIELD

The present invention relates to an air conditioner.

BACKGROUND ART

Among air conditioners, there is an air conditioner that is disposed with a casing in which suction openings and blowout openings are disposed, a filter that is disposed downstream of the suction openings, a heat exchanger that is disposed facing the filter downstream of the filter, a centrifugal fan, and blowout passages (see JP-A No. 61-79938). The blowout passages include an air introduction opening that is disposed facing the heat exchanger downstream of the heat exchanger and are passages that guide air from this air introduction opening to the blowout openings. The centrifugal fan generates a flow of air that is sucked in from the suction openings, passes through the filter, the heat exchanger and the blowout passages, and is blown out from the blowout openings.

SUMMARY OF THE INVENTION

Problem that the Invention is to Solve

In the air conditioner described above, indoor air that has been sucked in from the suction openings enters the blowout passages from the air introduction opening after the air has passed through the filter and the heat exchanger. In this case, it is easy for the flow velocity of the air to become large in the vicinity of the peripheral edge of the air introduction opening, and the flow rate of the air flowing in the vicinity of the peripheral edge of the air introduction opening becomes large. For this reason, it becomes easy for unevenness to arise in the flow of air that passes through the heat exchanger, and there is the potential for the efficiency of heat exchange to drop.

It is an object of the present invention to provide an air conditioner that can alleviate uneven flow in a flow of air that passes through a heat exchanger.

Means for Solving the Problem

An air conditioner pertaining to a first invention comprises a casing, a filter, a heat exchanger, a centrifugal fan and a blowout passage. The casing includes a suction opening through which air that is taken in from indoors passes and a blowout opening through which air that is blown out to the indoors passes. The filter is disposed downstream of the suction opening and is a member that transmits air. The heat exchanger is disposed facing the filter downstream of the filter and performs heat exchange with air that passes through the heat exchanger. The centrifugal fan is disposed downstream of the heat exchanger and generates a flow of air that is sucked in from the suction opening and is blown out from the blowout opening. The blowout passage includes an air introduction opening that is disposed facing the heat exchanger downstream of the heat exchanger and guide air from the air introduction opening to the blowout opening. Additionally, the filter has an outer shape that is slanted with respect to the heat exchanger.

In this air conditioner, the filter has an outer shape that is slanted with respect to the heat exchanger. For this reason, the flow of air that passes through the filter can be changed in comparison to when the filter has an outer shape that is parallel with respect to the heat exchanger. Thus, in this air conditioner, uneven flow in the flow of air that passes through the heat exchanger can be alleviated.

An air conditioner pertaining to a second invention comprises the air conditioner of the first invention, wherein the casing further includes a panel portion that is disposed on front surface of the casing, and the suction opening is disposed around the panel portion. Further, the filter is disposed facing the panel portion, and the surface of the filter on the panel portion side has a shape that slants with respect to the heat exchanger.

In this air conditioner, air that has been sucked in from around the panel portion proceeds along the inner surface of the panel portion, changes the direction of its flow, is transmitted through the filter, and proceeds to the heat exchanger. Here, the surface of the filter on the panel portion side has a shape that is slanted with respect to the heat exchanger, so the ease with which air is transmitted differs depending on the portion of the filter. Thus, in this air conditioner, uneven flow in the flow of air that passes through the heat exchanger can be alleviated.

An air conditioner pertaining to a third invention comprises the air conditioner of the second invention, wherein the surface of the filter on the panel portion side has a convex shape that projects toward the panel portion.

In this air conditioner, the surface of the filter on the panel portion side has a convex shape that projects toward the panel portion, so the ease with which air is transmitted differs depending on the portion of the filter. Thus, in this air conditioner, uneven flow in the flow of air that passes through the heat exchanger can be alleviated.

An air conditioner pertaining to a fourth invention comprises the air conditioner of the second or third invention, wherein the suction opening includes a first suction opening and a second suction opening that are disposed such that the panel portion is interposed therebetween. Additionally, the surface of the filter on the panel portion side includes a first slanted surface that is disposed on the first suction opening side and a second slanted surface that is disposed on the second suction opening side.

In this air conditioner, air that has been sucked in from the first suction opening is transmitted through the first slanted surface, whereby unevenness in the flow when the air passes through the heat exchanger can be alleviated. Further, air that has been sucked in from the second suction opening is transmitted through the second slanted surface, whereby unevenness in the flow when the air passes through the heat exchanger can be alleviated. For this reason, in this air conditioner, even when air is sucked in from two directions, uneven flow in the flow of air that passes through the heat exchanger can be alleviated.

An air conditioner pertaining to a fifth invention comprises the air conditioner of the fourth invention, wherein the suction opening further includes a third suction opening and a fourth suction opening that are disposed such that the panel portion is interposed therebetween in a direction orthogonal to the direction that interconnects the first suction opening and the second suction opening. Additionally, the surface of the filter on the panel portion side further includes a third slanted surface that is disposed on the third suction opening side and a fourth slanted surface that is disposed on the fourth suction opening side.

In this air conditioner, air that has been sucked in from the first suction opening is transmitted through the first slanted surface, whereby unevenness in the flow when the air passes through the heat exchanger can be alleviated. Air that has been sucked in from the second suction opening is transmitted through the second slanted surface, whereby unevenness in the flow when the air passes through the heat exchanger can be alleviated. Air that has been sucked in from the third suction opening is transmitted through the third slanted surface, whereby unevenness in the flow when the air passes through the heat exchanger can be alleviated. Further, air that has been sucked in from the fourth suction opening is transmitted through the fourth slanted surface, whereby unevenness in the flow when the air passes through the heat exchanger can be alleviated. For this reason, in this air conditioner, even when air is sucked in from four directions, uneven flow in the flow of air that passes through the heat exchanger can be alleviated.

An air conditioner pertaining to a sixth invention comprises the air conditioner of the second or third invention, wherein the suction opening includes a first suction opening and a second suction opening that are disposed such that the panel portion is interposed therebetween. Additionally, the surface of the filter on the panel portion side includes a curved portion that is curved such that its intermediate portion in a direction interconnecting the first suction opening side and the second suction opening side projects toward the panel portion.

In this air conditioner, air that has been taken in from the two directions of the first suction opening and the second suction opening is transmitted through the curved portion. Additionally, the flow of air can be changed by the curved portion. Thus, in this air conditioner, uneven flow in the flow of air that passes through the heat exchanger can be alleviated.

An air conditioner pertaining to a seventh invention comprises the air conditioner of the second or third invention, wherein the suction opening includes a first suction opening, a second suction opening, a third suction opening and a fourth suction opening that are disposed separately in four directions of the panel portion. Additionally, the surface of the filter on the panel portion side has a spherical shape that projects toward the panel portion.

In this air conditioner, the surface of the filter on the panel portion side includes a spherical portion that is spherically shaped such as described above, so even when air is sucked in from four directions, uneven flow in the flow of air that passes through the heat exchanger can be alleviated.

An air conditioner pertaining to an eighth invention comprises a casing, a filter, a heat exchanger, a centrifugal fan and a blowout passage. The casing includes a suction opening through which air that is taken in from indoors passes and blowout opening through which air that is blown out to the indoors passes. The filter is disposed downstream of the suction opening and is a member that transmits air. The heat exchanger is disposed facing the filter downstream of the filter and performs heat exchange with air that passes through the heat exchanger. The centrifugal fan is disposed downstream of the heat exchanger and generates a flow of air that is sucked in from the suction opening and is blown out from the blowout opening. The blowout passage includes an air introduction opening that is disposed facing the heat exchanger downstream of the heat exchanger and guide air from the air introduction opening to the blowout opening. Additionally, the filter includes a thick portion that is disposed in a position facing an edge portion of the air introduction opening and whose thickness is greater than that of the other portion of the filter.

In this air conditioner, the portion of the filter that faces the edge portion of the air introduction opening has a thickness that is greater than that of the other portion of the filter, so the ease with which air is transmitted through this portion of the filter is different from that of the other portion of the filter. For this reason, the flow of air that passes through the filter can be changed in comparison to when the filter has a uniform thickness. Thus, in this air conditioner, uneven flow in the flow of air that passes through the heat exchanger can be alleviated.

An air conditioner pertaining to a ninth invention comprises the air conditioner of the eighth invention, wherein the casing further includes a panel portion that is disposed on front surface of the casing, and the suction opening is disposed around the panel portion. Further, the filter is disposed facing the panel portion.

In this air conditioner, air that has been sucked in from around the panel portion proceeds along the inner surface of the panel portion, changes the direction of its flow, is transmitted through the filter, and proceeds to the heat exchanger. Here, the portion of the filter that faces the edge portion of the air introduction opening has a thickness that is greater than that of the other portion of the filter, so the ease with which air is transmitted through this portion of the filter is different from that of the other portion of the filter. Thus, in this air conditioner, uneven flow in the flow of air that passes through the heat exchanger can be alleviated.

Effects of the Invention

In the air conditioner pertaining to the first invention, the filter has an outer shape that is slanted with respect to the heat exchanger. For this reason, the flow of air that passes through the filter can be changed in comparison to when the filter has an outer shape that is parallel with respect to the heat exchanger. Thus, in this air conditioner, uneven flow in the flow of air that passes through the heat exchanger can be alleviated.

In the air conditioner pertaining to the second invention, air that has been sucked in from around the panel portion proceeds along the inner surface of the panel portion, changes the direction of its flow, is transmitted through the filter, and proceeds to the heat exchanger. Here, the surface of the filter on the panel portion side has a shape that is slanted with respect to the heat exchanger, so the ease with which air is transmitted differs depending on the portion of the filter. Thus, in this air conditioner, uneven flow in the flow of air that passes through the heat exchanger can be alleviated.

In the air conditioner pertaining to the third invention, the surface of the filter on the panel portion side has a convex shape that projects toward the panel portion, so the ease with which air is transmitted differs depending on the portion of the filter. Thus, in this air conditioner, uneven flow in the flow of air that passes through the heat exchanger can be alleviated.

In the air conditioner pertaining to the fourth invention, air that has been sucked in from the first suction opening is transmitted through the first slanted surface, whereby unevenness in the flow when the air passes through the heat exchanger can be alleviated. Further, air that has been sucked in from the second suction opening is transmitted through the second slanted surface, whereby unevenness in the flow when the air passes through the heat exchanger can be alleviated. For this reason, in this air conditioner, even when air is sucked in from two directions, uneven flow in the flow of air that passes through the heat exchanger can be alleviated.

In the air conditioner pertaining to the fifth invention, air that has been sucked in from the first suction opening is transmitted through the first slanted surface, whereby unevenness in the flow when the air passes through the heat exchanger can be alleviated. Air that has been sucked in from the second suction opening is transmitted through the second slanted surface, whereby unevenness in the flow when the air passes through the heat exchanger can be alleviated. Air that has been sucked in from the third suction opening is transmitted through the third slanted surface, whereby unevenness in the flow when the air passes through the heat exchanger can be alleviated. Further, air that has been sucked in from the fourth suction opening is transmitted through the fourth slanted surface, whereby unevenness in the flow when the air passes through the heat exchanger can be alleviated. For this reason, in this air conditioner, even when air is sucked in from four directions, uneven flow in the flow of air that passes through the heat exchanger can be alleviated.

In the air conditioner pertaining to the sixth invention, air that has been taken in from the two directions of the first suction opening and the second suction opening is transmitted through the curved portion. Additionally, the flow of air can be changed by the curved portion. Thus, in this air conditioner, uneven flow in the flow of air that passes through the heat exchanger can be alleviated.

In the air conditioner pertaining to the seventh invention, the surface of the filter on the panel portion side includes a spherical portion that is spherically shaped such as described above, so even when air is sucked in from four directions, uneven flow in the flow of air that passes through the heat exchanger can be alleviated.

In the air conditioner pertaining to the eighth invention, the portion of the filter that faces the edge portion of the air introduction opening has a thickness that is greater than that of the other portion of the filter, so the ease with which air is transmitted through this portion of the filter is different from that of the other portion of the filter. For this reason, the flow of air that passes through the filter can be changed in comparison to when the filter has a uniform thickness. Thus, in this air conditioner, uneven flow in the flow of air that passes through the heat exchanger can be alleviated.

In the air conditioner pertaining to the ninth invention, air that has been sucked in from around the panel portion proceeds along the inner surface of the panel portion, changes the direction of its flow, is transmitted through the filter, and proceeds to the heat exchanger. Here, the portion of the filter that faces the edge portion of the air introduction opening has a thickness that is greater than that of the other portion of the filter, so the ease with which air is transmitted through this portion of the filter is different from that of the other portion of the filter. Thus, in this air conditioner, uneven flow in the flow of air that passes through the heat exchanger can be alleviated.

BRIEF DESCRIPTION OF THE DRAWINGS

FIGS. 6(*a*) and 6(*b*) are a top sectional view and a front view showing a configuration in the vicinity of a filter of a second embodiment.

DETAILED DESCRIPTION OF THE INVENTION

First Embodiment

Figure 1:
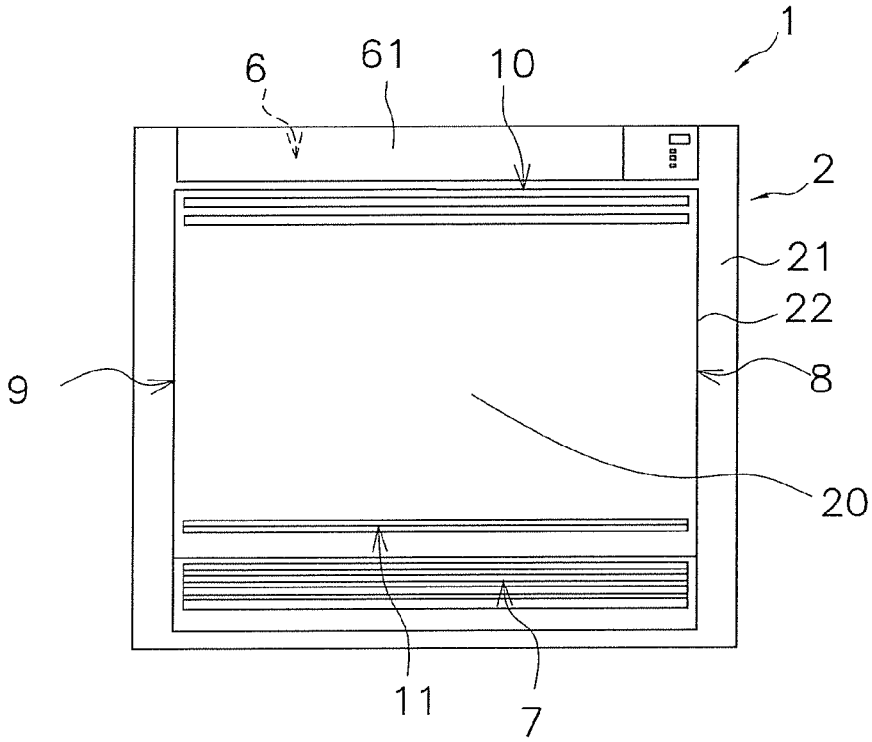
FIG. 1 is a front view of an air conditioner.
Figure 2:
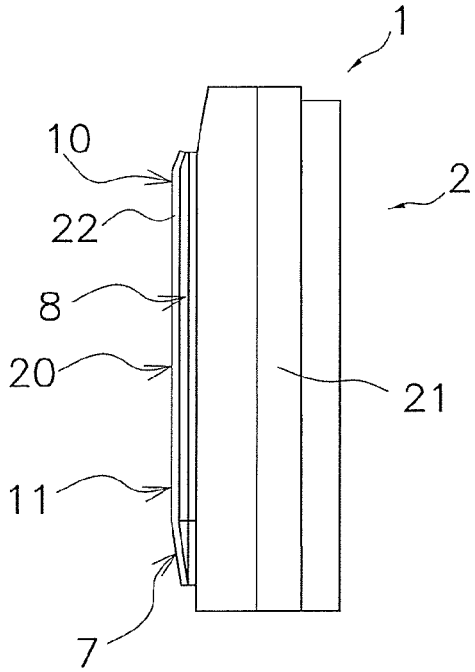
FIG. 2 is a side view of the air conditioner.
Figure 3:
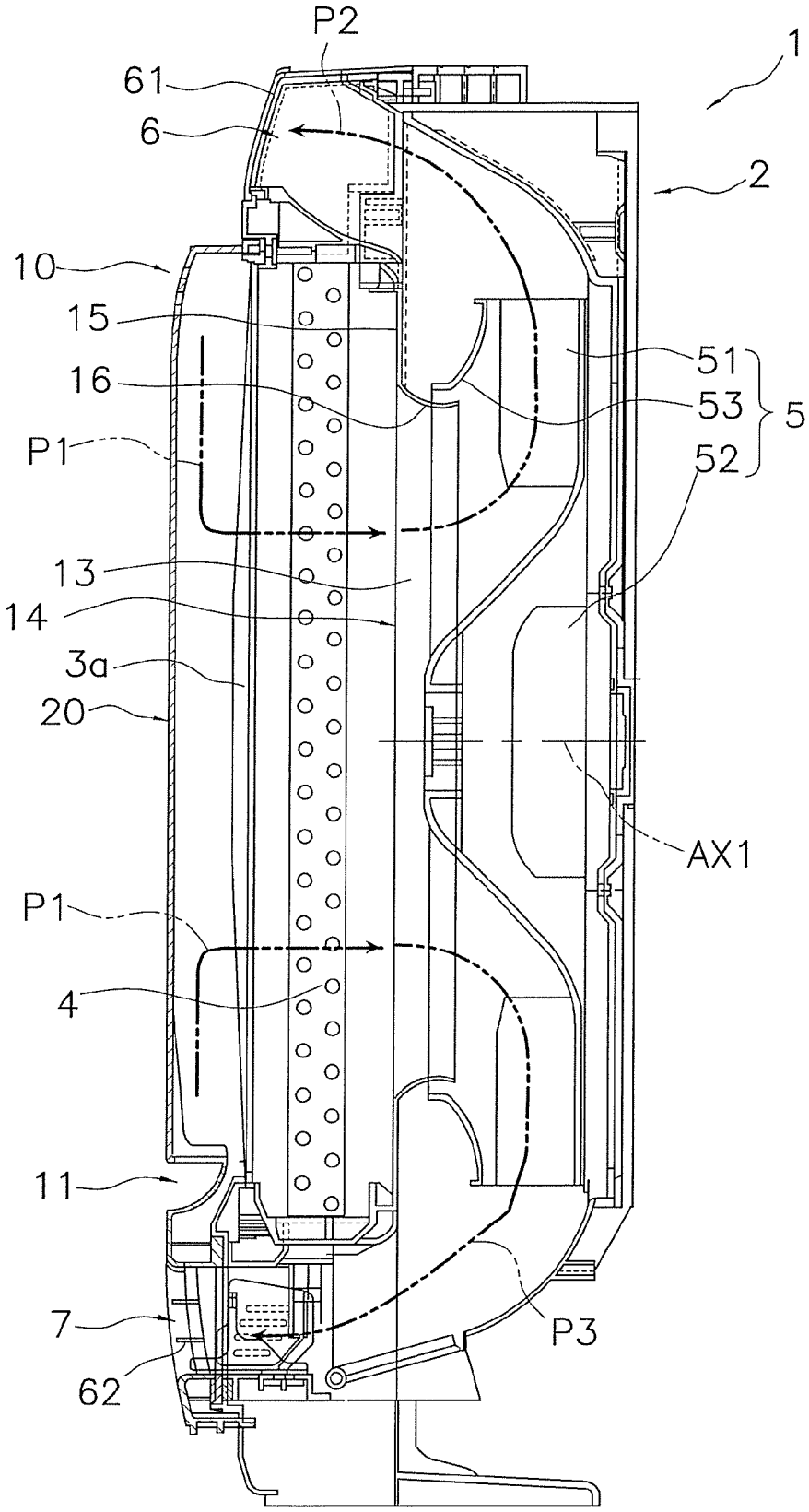
FIG. 3 is a side sectional view of the air conditioner.

FIG. 1 to FIG. 3 show an air conditioner 1 pertaining to an embodiment of the present invention. FIG. 1 is a front view of the air conditioner 1, and FIG. 2 is a side view of the air conditioner 1. Further, FIG. 3 is a side sectional view of the air conditioner 1. The air conditioner 1 is a floor-placed indoor machine and is disposed with a casing 2, a filter 3*a*, an indoor heat exchanger 4 and a blower 5. It will be noted that when the terms "upper", "lower", "left" and "right" are mentioned in the following description, these will mean "upper", "lower", "right" and "left" when the air conditioner 1 is seen from the front.

<Casing 2>

The casing 2 comprises a hollow casing that is made of a synthetic resin and houses inside the filter 3*a*, the indoor heat exchanger 4, a bellmouth 13 and the blower 5. A first blowout opening 6, a second blowout opening 7, a first suction opening 8, a second suction opening 9, a third suction opening 10 and a fourth suction opening 11 are disposed in the casing 2.

The first blowout opening 6 and the second blowout opening 7 are disposed in the front surface of the casing 2. The first blowout opening 6 is a horizontally long-shaped opening that is disposed along the upper end of the front surface of the casing 2, and air that is blown out to the indoors passes therethrough. The second blowout opening 7 is a horizontally long-shaped opening that is disposed along the lower end of the front surface of the casing 2, and air that is blown out to the indoors passes therethrough. It will be noted that a first flap 61 that guides air that is blown out from the first blowout opening 6 is disposed in the first blowout opening 6 such that the first flap 61 may freely pivot, and the first blowout opening 6 can be opened and closed by the first flap 61. Further, a second flap 62 that guides air that is blown out from the second blowout opening 7 is disposed in the second blowout opening 7 such that the second flap 62 may freely pivot.

The first suction opening 8 and the second suction opening 9 are disposed in the side surfaces of the casing 2. The first suction opening 8 is a vertically long-shaped opening that is disposed along the front end of the right side surface of the casing 2, and air that is sucked into the inside of the casing 2 from the indoors passes therethrough. The second suction opening 9 is a vertically long-shaped opening that is disposed along the front end of the left side surface of the casing 2, and air that is sucked into the inside of the casing 2 from the indoors passes therethrough.

The third suction opening 10 and the fourth suction opening 11 are disposed in the front surface of the casing 2. The third suction opening 10 is a horizontally long-shaped opening that is disposed below the first blowout opening 6, and air that is sucked into the inside of the casing 2 from the indoors passes therethrough. The fourth suction opening 11 is a horizontally long-shaped opening that is disposed above the second blowout opening 7, and air that is sucked into the inside of the casing 2 from the indoors passes therethrough. Further, a flat panel portion 20 in which an opening is not disposed is disposed between the third suction opening 10 and the fourth suction opening 11 on the front surface of the casing 2.

It will be noted that the casing 2 includes a casing body 21 and a front panel 22 that is detachably attached to the front surface of the casing body 21, and the second blowout opening 7, the first suction opening 8, the second suction opening 9, the third suction opening 10 and the fourth suction opening 11 are disposed in the front panel 22. It will be noted that the first blowout opening 6 is disposed in the casing body 21.

The front panel 22 has an outer shape that is smaller than the front surface of the casing body 21, and the front panel 22 is disposed below the first blowout opening 6 when seen from the front. The third suction opening 10 is disposed in the vicinity of the upper end of the front panel 22, and the second blowout opening 7 is disposed in the vicinity of the lower end of the front panel 22. It will be noted that, as mentioned above, the fourth suction opening 11 is disposed above the second blowout opening 7. Further, the front surface of the front panel 22 is disposed a slight distance forward from the front surface of the casing body 21, and the first suction opening 8 and the second suction opening 9 are disposed in the side surfaces of the front panel 22 that connect the front side end portion of the front panel 22 and the front surface of the casing body 21. Further, the upper surface of the front panel 22 that connects the front upper end portion of the front panel 22 and the front surface of the casing body 21 and the lower surface of the front panel 22 that connects the front lower end of the front panel 22 and the front surface of the casing body 21 are closed. It will be noted that the third suction opening 10 may also be disposed in the upper surface of the front panel 22 rather than in the front surface of the front panel 22.

As described above, the third suction opening 10 to the second suction opening 9 are respectively disposed in the four directions of the upper side, the lower side, the left side and the right side around the flat panel portion 20 of the front panel 22 in the casing 2, and air is sucked in from the four directions of the upper side, the lower side, the left side and the right side of the flat panel portion 20.

A large opening is formed in the front surface of the casing body 21, and the filter 3*a*, the indoor heat exchanger 4, the bellmouth 13 and the blower 5 are disposed inside the casing body 21 in order from front to back facing the opening in the front surface of the casing body 21.

Further, as shown in FIG. 3, a suction passage P1 and a blowout passage P2 and P3 are formed inside the casing 2.

The suction passage P1 is formed behind the front panel 22 and guide air that has been sucked in from the first suction opening 8, the second suction opening 9, the third suction opening 10 and the fourth suction opening 11 to an air introduction opening 14 in the bellmouth 13. The filter 3*a* and the indoor heat exchanger 4 are disposed in the suction passage P1.

The blowout passage P2 and P3 is a passage that guides air from the air introduction opening 14 (described later) in the bellmouth 13 that is disposed facing the indoor heat exchanger 4 downstream of the indoor heat exchanger 4 to the first blowout opening 6 and the second blowout opening 7, and includes a first blowout passage P2 and a second blowout passage P3. The first blowout passage P2 is a passage that leads from the air introduction opening 14 rearward through the inside of a fan cover 53 (described later) of the blower 5 to the first blowout opening 6. The second blowout passage P3 is a passage that leads from the air introduction opening 14 rearward through the inside of the fan cover 53 to the second blowout opening 7.

<Filter 3*a*>

The filter 3*a* is disposed facing the flat panel portion 20 behind the flat panel portion 20 and is attached so as to cover the opening in the front surface of the casing body 21. The filter 3*a* is positioned downstream of each of the suction opening 8 to 11 in the flow of air that passes through the suction passage P1. The filter 3*a* transmits air that has been sucked in from each of the suction opening 8 to 11 rearward and purifies the passing air. The shape of the filter 3*a* will be described in detail later.

<Indoor Heat Exchanger 4>

The indoor heat exchanger 4 configures a refrigerant circuit together with an unillustrated outdoor heat exchanger and performs heat exchange with air that passes through the indoor heat exchanger 4. The indoor heat exchanger 4 is disposed facing the filter 3*a* behind the filter 3*a* and is positioned downstream of the filter 3*a* in the flow of air that passes through the suction passage P1. The indoor heat exchanger 4 has a thin plate-like outer shape and has about the same size as the filter 3*a* when seen from the front. The indoor heat exchanger 4 is disposed parallel to the flat panel portion 20.

<Blower 5>

The blower 5 is disposed facing the indoor heat exchanger 4 behind the indoor heat exchanger 4. The blower 5 is positioned downstream of the indoor heat exchanger 4 in the flow of air that passes through the suction passage P1 and the blowout passage P2 and P3. Further, the blower 5 is a turbo fan, which is one type of centrifugal fan that blows out air in a centrifugal direction, and generates a flow of air that is sucked in from each of the suction opening 8 to 11 and is blown out from each of the blowout opening 6 and 7. The blower 5 includes a fan rotor 51, a fan motor 52 and the fan cover 53.

The fan rotor 51 is disposed such that its axis-of-rotation AX1 becomes horizontal in the front-rear direction and includes plural blades that are disposed so as to spiral away from the axis-of-rotation AX1.

The fan motor 52 is a drive source that drives the fan rotor 51 to rotate and is disposed behind the fan rotor 51.

The fan cover 53 is a member that is disposed in front of the fan rotor 51 and guides air that is blown out from the air introduction opening 14 to the fan rotor 51. An opening through which air that is taken inside the fan cover 53 passes is disposed in the front surface of the fan cover 53. Air that passes through the opening in the front surface of the fan cover 53 branches up and down as a result of being blown out in the centrifugal direction by the fan rotor 51 and is blown out to the indoors from the first blowout opening 6 and the second blowout opening 7.

<Bellmouth 13>

The bellmouth 13 is disposed between the indoor heat exchanger 4 and the blower 5, and is a member that partitions the suction passage P1 and the blowout passage P2 and P3. The bellmouth 13 includes a flat portion 15 and a circular tube portion 16. The flat portion 15 has an outer shape that is about the same size as that of the indoor heat exchanger 4 when seen from the front, and is disposed parallel to the indoor heat exchanger 4 facing the rear surface of the indoor heat exchanger 4. The aforementioned air introduction opening 14 is disposed in the flat portion 15, and the front end of the circular tube portion 16 is connected to the peripheral edge of the air introduction opening 14 in the flat portion 15. It will be noted that the circular tube portion 16 curves such that the diameter of its front end side expands, and the circular tube portion 16 is gently connected to the peripheral edge of the air introduction opening 14. Further, the rear end of the circular tube portion 16 enters the inside of the fan cover 53 through the opening in the front surface of the fan cover 53. It will be noted that the air introduction opening 14 has an outer shape that is smaller than that of the indoor heat exchanger 4 when seen from the front, and the circular tube portion 16 also has an outer shape that is smaller than that of the indoor heat exchanger 4 when seen from the front.

<Shape of Filter 3*a*>

Figure 4:
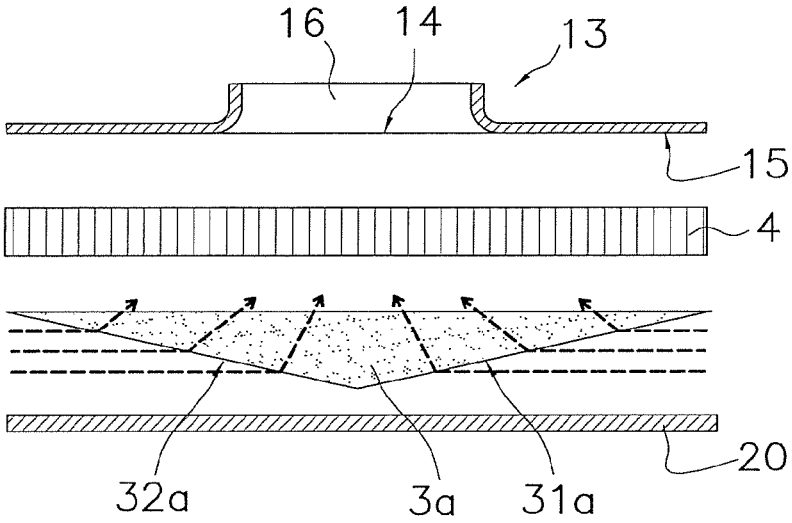
FIGS. 4(*a*) and 4(*b*) are a top sectional view and a side sectional view showing a configuration in the vicinity of a filter of a first embodiment.
Figure 4:
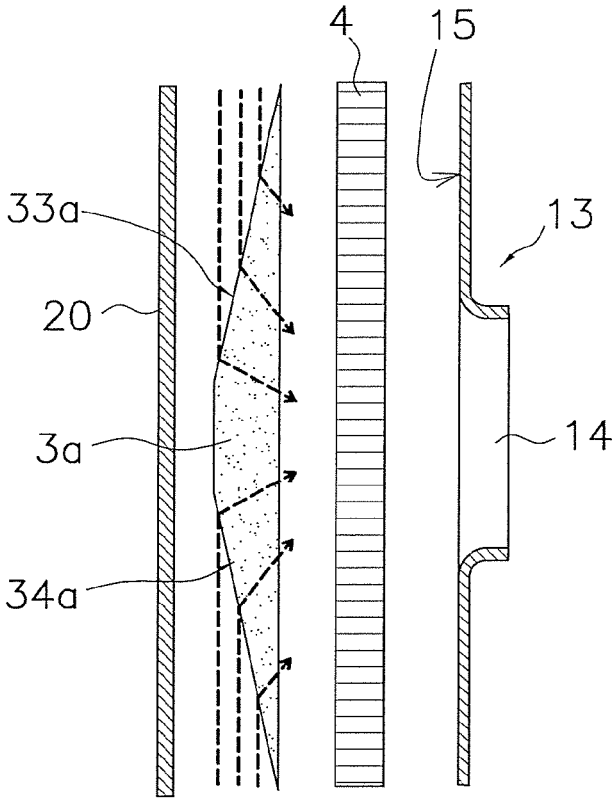

Below, the characteristic shape of the filter 3*a* in the present invention will be described. As shown in FIGS. 4(*a*) and 4(*b*) and FIG. 5, the surface of the filter 3*a* on the flat panel portion 20 side has a convex shape that projects toward the flat panel portion 20 and has an outer shape that is slanted with respect to the indoor heat exchanger 4, the flat panel portion 20 and the flat portion 15 of the bellmouth 13. It will be noted that FIG. 4(*a*) is a top sectional view showing the configuration in the vicinity of the filter 3*a*, and FIG. 4(*b*) is a side sectional view showing the configuration in the vicinity of the filter 3*a*. Further, FIG. 5 is a front view of the filter 3*a*.

The surface of the filter 3*a* on the flat panel portion 20 side includes a first slanted surface 31*a*, a second slanted surface 32*a*, a third slanted surface 33*a* and a fourth slanted surface 34*a*. The first slanted surface 31*a*, the second slanted surface 32*a*, the third slanted surface 33*a* and the fourth slanted surface 34*a* all have a flat shape, and these are combined to form the convex shape of the filter 3*a*.

Figure 5:
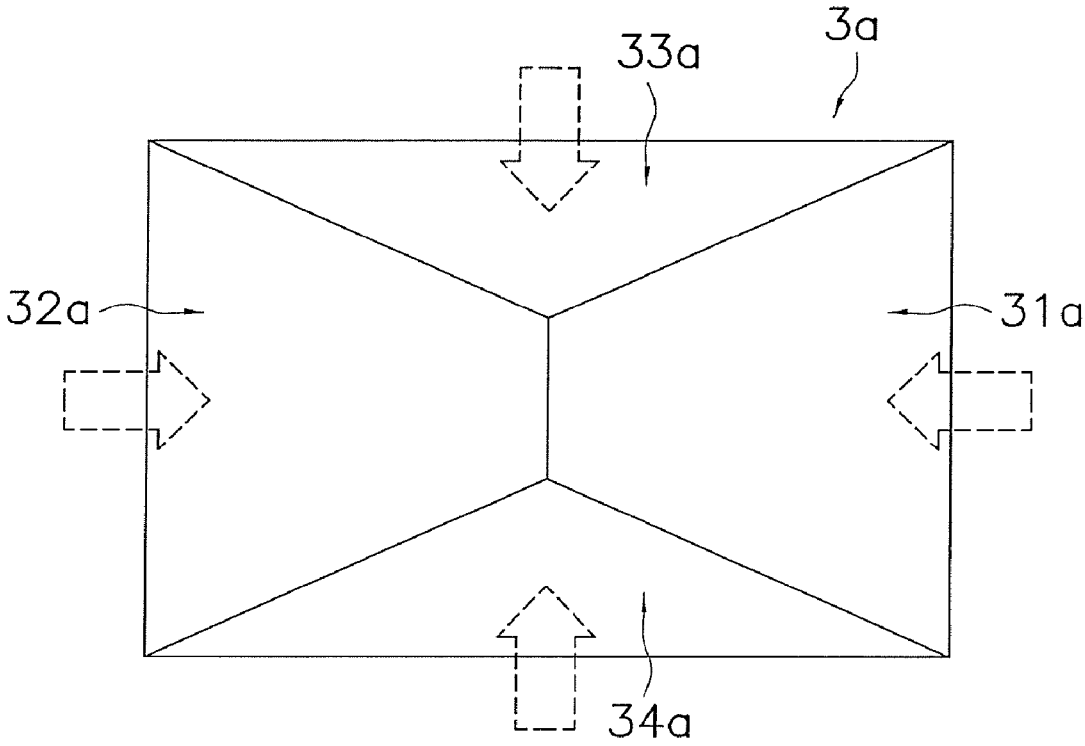
FIG. 5 is a front view of the filter of the first embodiment.

The first slanted surface 31*a* is disposed on the right side (the first suction opening 8 side) when the filter 3*a* is divided into upper, lower, left and right sides and, as shown in FIG. 5, the first slanted surface 31*a* is disposed between the third slanted surface 33*a* and the fourth slanted surface 34*a*. The first slanted surface 31*a* slants such that its left end portion is closer to the flat panel portion 20 than its right end portion. For this reason, the space between the first slanted surface 31*a* and the flat panel portion 20 is such that its right side is wide and its left side—that is, the central portion side of the filter 3*a*—is narrow.

The second slanted surface 32*a* is disposed on the left side (the second suction opening 9 side) and is disposed on the left side of the first suction opening 8 between the third slanted surface 33*a* and the fourth slanted surface 34*a*. The second slanted surface 32*a* slants such that its right end portion is closer to the flat panel portion 20 than its left end portion. For this reason, the space between the second slanted surface 32*a* and the flat panel portion 20 is such that its left side is wide and its right side—that is, the central portion side of the filter 3*a*—is narrow.

The third slanted surface 33*a* is disposed on the upper side (the third suction opening 10 side) and, as shown in FIG. 4(*b*), slants such that its lower end portion is closer to the front panel 22 than its upper end portion. For this reason, the space between the third slanted surface 33*a* and the flat panel portion 20 is such that its upper side is wide and its lower side—that is, the central portion side of the filter 3*a*—is narrow.

The fourth slanted surface 34*a* is disposed on the lower side (the fourth suction opening 11 side) and is positioned lower than the third slanted surface 33*a*. The fourth slanted surface 34*a* slants such that its upper end portion is closer to the flat panel portion 20 than its lower end portion. For this reason, the space between the fourth slanted surface 34*a* and the flat panel portion 20 is such that its lower side is wide and its upper side—that is, the central portion side of the filter 3*a*—is narrow.

It will be noted that the first slanted surface 31*a* and the second slanted surface 32*a* are arranged and disposed in the left-right direction and have a bilaterally symmetrical shape. Further, the third slanted surface 33*a* and the fourth slanted surface 34*a* are arranged and disposed in the top-bottom direction and have a vertically symmetrical shape. For this reason, the filter 3*a* has a vertically symmetrical and bilaterally symmetrical convex shape, and the center thereof is disposed facing the air introduction opening 14 in the bellmouth 13.

<Characteristics>

(1)

In this air conditioner 1, air that has been sucked in from the first suction opening 8, the second suction opening 9, the third suction opening 10 and the fourth suction opening 11 proceeds along the inner surface of the flat panel portion 20 and changes the direction of its flow toward the air introduction opening 14 in the vicinity of a position facing the air introduction opening 14 (refer to the wave-line arrows in FIGS. 4(*a*) and 4(*b*)). Here, the filter 3*a* has a slanted shape as described above and is disposed so as to intersect the traveling direction of the air that proceeds along the inner surface of the flat panel portion 20. For this reason, the flow velocity of the air that proceeds along the inner surface of the flat panel portion 20 and the direction of the flow change as a result of the air coming into contact with the slanted surfaces 31*a* to 34*a* of the filter 3*a*. Thus, a situation where the flow of air becomes concentrated in the vicinity of the peripheral edge portion of the air introduction opening 14 in the bellmouth 13 can be controlled, and uneven flow in the flow of air that passes through the indoor heat exchanger 4 can be alleviated.

(2)

In this air conditioner 1, the first slanted surface 31*a*, the second slanted surface 32*a*, the third slanted surface 33*a* and the fourth slanted surface 34*a* are disposed in correspondence to the first suction opening 8, the second suction opening 9, the third suction opening 10 and the fourth suction opening 11. For this reason, even when air is sucked in from the four direction of the upper side, the lower side, the left side and the right side of the flat panel portion 20, a situation where the flow of air becomes concentrated in the vicinity of the peripheral edge portion of the air introduction opening 14 in the bellmouth 13 can be controlled.

Second Embodiment

Figure 6:
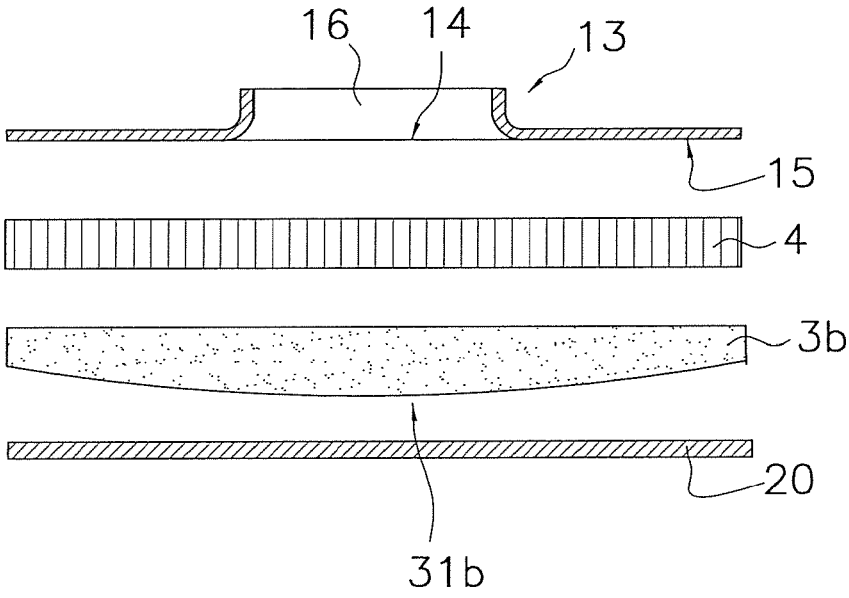
FIG. 6 is a top sectional view and a front view showing a configuration in the vicinity of a filter of a second embodiment.
Figure 6:
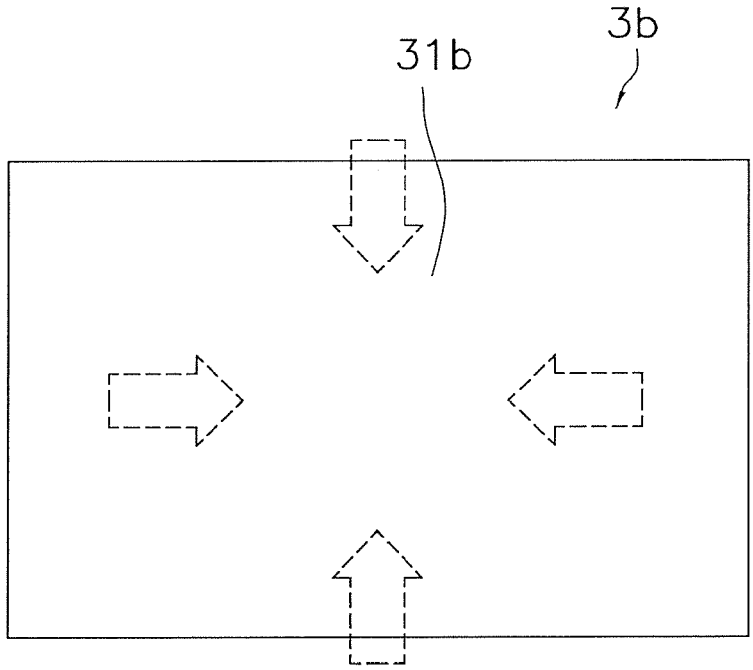

Instead of the filter 3*a* of the first embodiment, a filter 3*b* shown in FIGS. 6(*a*) and 6(*b*) may also be disposed. FIG. 6(*a*) is a top sectional view showing the configuration in the vicinity of the filter 3*b*, and FIG. 6(*b*) is a front view of the filter 3*b*. The surface of the filter 3*b* on the flat panel portion 20 side includes a spherical portion 31*b* that has a spherical shape that projects toward the flat panel portion 20. The spherical portion 31*b* is disposed facing the air introduction portion 14 in the bellmouth 13. It will be noted that "spherical" here does not invariably mean a strictly spherical surface; it suffices as long as the surface is a curved surface that approximates a spherical surface.

Other configurations are the same as those of the first embodiment.

In this filter 3*b*, the flow velocity of the air that proceeds along the inner surface of the flat panel portion 20 and the direction of the flow can be changed by the spherical portion 31*b*. For this reason, even when the filter 3*b* is used, similar to the filter 3*a* of the first embodiment, uneven flow in the flow of air that passes through the indoor heat exchanger 4 can be alleviated. Further, the filter 3*b* is effective also when air is sucked in from the four directions of the upper side, the lower side, the left side and the right side of the flat panel portion 20.

Third Embodiment

Figure 7:
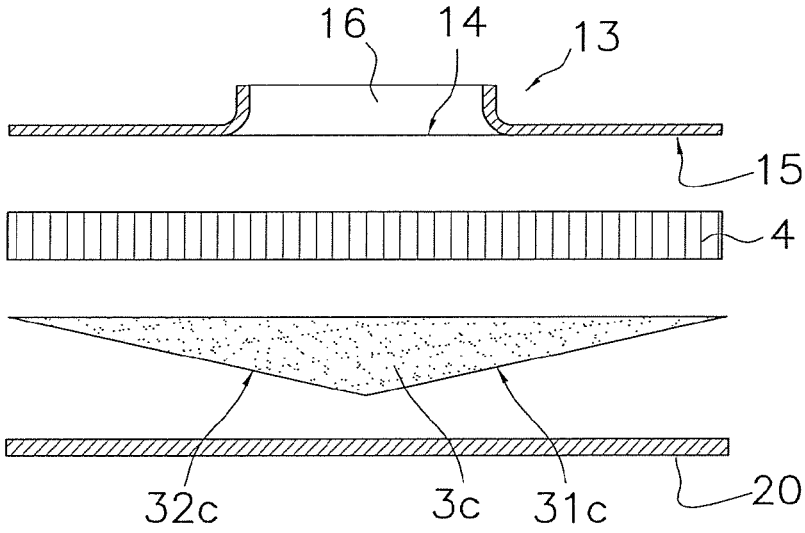
FIGS. 7(*a*) and 7(*b*) are a top sectional view and a front view showing a configuration in the vicinity of a filter of a third embodiment.
Figure 7:
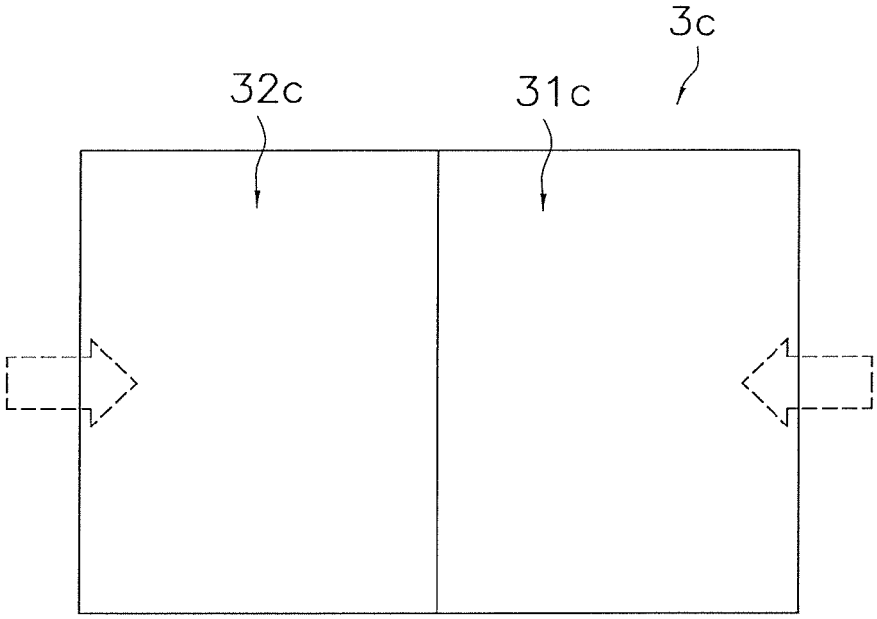

Instead of the filter 3*a* of the first embodiment, a filter 3*c* shown in FIGS. 7(*a*) and 7(*b*) may also be disposed. FIG. 7(*a*) is a top sectional view showing the configuration in the vicinity of the filter 3*c*, and FIG. 7(*b*) is a front view of the filter 3*c*. The surface of the filter 3*c* on the flat panel portion 20 side has a mountain-like shape that is formed as a result of two slanted surfaces 31*c* and 32*c* being combined so as to be bilaterally symmetrical. Specifically, the filter 3*c* includes a first slanted surface 31*c* that is disposed on the first suction opening 8 side (the right side) and a second slanted surface 32*c* that is disposed on the second suction opening 9 side (the left side). The left end portion of the first slanted surface 31*c* is connected to the right end portion of the second slanted surface 32*c*, and the portion where the first slanted surface 31*c* and the second slanted surface 32*c* are interconnected becomes the apex of a convex shape. It will be noted that the slanting directions of the first slanted surface 31*c* and the second slanted surface 32*c* are the same as those of the first slanted surface 31*a* and the second slanted surface 32*a* of the filter 3*a* of the first embodiment.

Other configurations are the same as those of the first embodiment.

With this filter 3*c* also, similar to when the filter 3*a* of the first embodiment is used, uneven flow in the flow of air that passes through the indoor heat exchanger 4 can be alleviated. This filter 3*c* is particularly effective for sucking in air from the two directions of the left side and the right side of the flat panel portion 20.

It will be noted that a filter having a shape where the filter 3*c* has been rotated 90° about an axis-of-rotation that is parallel to the front-rear direction may also be disposed. In this case, the filter is particularly effective for sucking in air from the two directions of the upper side and the lower side of the flat panel portion 20.

Fourth Embodiment

Figure 8:
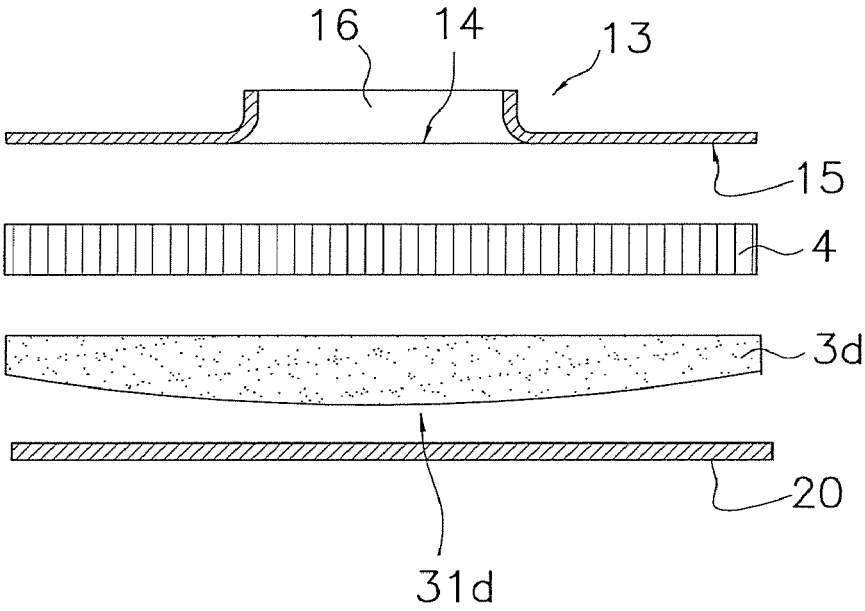
FIGS. 8(*a*) and 8(*b*) are a top sectional view and a front view showing a configuration in the vicinity of a filter of a fourth embodiment.
Figure 8:
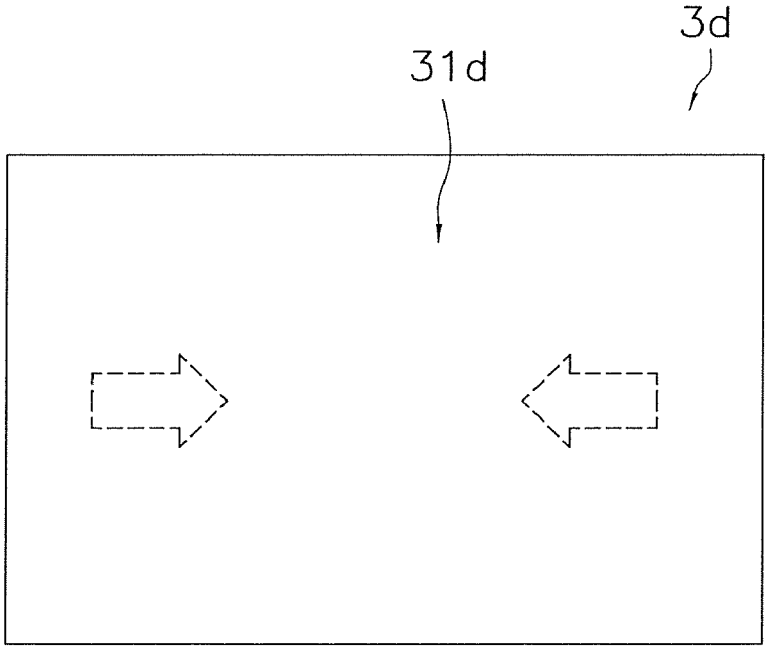

Instead of the filter 3*a* of the first embodiment, a filter 3*d* shown in FIGS. 8(*a*) and 8(*b*) may also be disposed. FIG. 8(*a*) is a top sectional view showing the configuration in the vicinity of the filter 3*d*, and FIG. 8(*b*) is a front view of the filter 3*d*. The surface of the filter 3*d* on the flat panel portion 20 side includes a curved portion 31*d* that is curved such that its intermediate portion in the left-right direction projects toward the flat panel portion 20, and the surface of the filter 3*d* on the flat panel portion 20 side has a bilaterally symmetrical shape.

Other configurations are the same as those of the first embodiment.

With this filter 3*d* also, similar to when the filter 3*a* of the first embodiment is used, uneven flow in the flow of air that passes through the indoor heat exchanger 4 can be alleviated. This filter 3*d* is particularly effective when air is sucked in from the two directions of the left side and the right side of the flat panel portion 20.

It will be noted that a filter having a shape where the filter 3*d* has been rotated 90° about an axis-of-rotation that is parallel to the front-rear direction may also be disposed. In this case, the filter is particularly effective for sucking in air from the two directions of the upper side and the lower side of the flat panel portion 20.

Fifth Embodiment

Figure 9A:
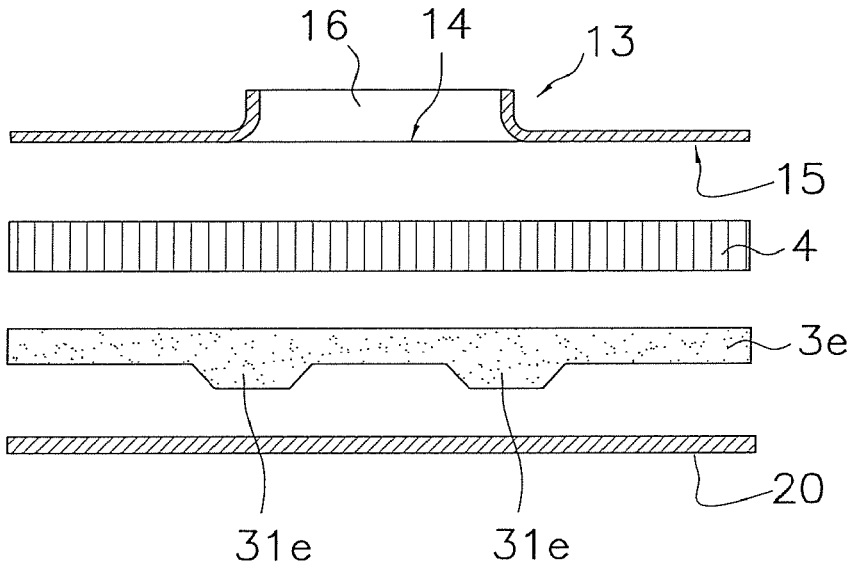
FIGS. 9(*a*) and 9(*b*) are a top sectional view and a front view showing a configuration in the vicinity of a filter of a fifth embodiment.
Figure 9B:
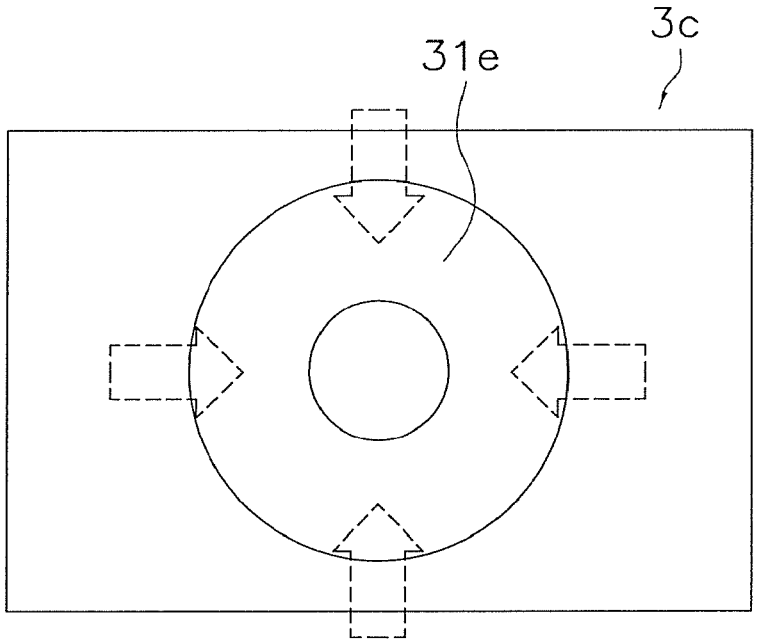

Instead of the filter 3*a* of the first embodiment, a filter 3*e* shown in FIGS. 9(*a*) and 9(*b*) may also be disposed. The portion of the filter 3*e* that faces the peripheral edge portion of the air introduction opening 14 is configured as a thick portion 31*e* whose thickness is greater than that of the other portion of the filter 3*e*.

In this filter 3*e*, the flow velocity of the air that passes along the inner surface of the flat panel portion 20 and the direction of the flow can be changed by the thick portion 31*e*. For this reason, similar to when the filter 3*a* of the first embodiment is used, uneven flow in the flow of air that passes through the indoor heat exchanger 4 can be alleviated. In particular, disposing the thick portion 31*e* in a circular shape similar to the peripheral edge portion of the air introduction opening 14 is effective also for sucking in air from the four directions of the upper side, the lower side, the left side and the right side of the flat panel portion 20.

Other Embodiments (A)

In the preceding embodiments, the present invention is applied to an air conditioner that is a floor-placed indoor machine, but the present invention is also applicable to other types of air conditioners, such as ceiling-embedded and wall-mounted air conditioners.

(B)

In the preceding embodiments, the present invention is applied to a type of air conditioner where air is sucked in from around the flat panel portion 20, but the present invention is also applicable with respect to an air conditioner where a suction opening is disposed in a position where the flat panel portion 20 is disposed. However, because it is easy for the problem of uneven flow to arise when air is sucked in from around the flat panel portion 20, the present invention is particularly effective for this type of air conditioner.

(C)

In the preceding embodiments, air is sucked in from the four directions of the upper side, the lower side, the left side and the right side of the flat panel portion 20, but the present invention is effective also when air is sucked in from just the two directions of the upper side and the lower side or from just the two directions of the left side and the right side of the flat panel portion 20.

INDUSTRIAL APPLICABILITY

The present invention has the effect that it can alleviate uneven flow in a flow of air that passes through a heat exchanger, and is useful as an air conditioner.

What is claimed is:

1. An air conditioner comprising:

a casing having a flat panel portion disposed on a front surface, a suction opening having a first suction opening and a second suction opening which are disposed with the flat panel portion in between and through which air that is taken in from indoors passes and a blowout opening through which air that is blown out to the indoors passes, the first suction opening being disposed on a right side surface located on a right side of the flat panel portion, and the second suction opening being disposed on a left side surface located on a left side of the flat panel portion;

a filter being disposed facing the flat panel portion downstream of the suction opening and being configured and arranged to transmit air;

a heat exchanger being disposed facing the filter behind the filter and performing heat exchange with air that passes through the heat exchanger;

a centrifugal fan being disposed behind the heat exchanger;

a bellmouth having an air introduction opening that is disposed facing the heat exchanger behind the heat exchanger and that has an outer shape that is smaller than that of the heat exchanger when seen from the front, and being disposed between the heat exchanger and the centrifugal fan; and a blowout passage being configured to guide air from the air introduction opening to the blowout opening, the centrifugal fan being configured to generate a flow of air that is sucked in from the suction opening and flows from a direction along a back of the flat panel portion toward the air introduction opening and passes through the filter, the heat exchanger and the air introduction opening and is blown out from the blowout opening, a surface of the filter on a flat panel portion side having a first slanted surface disposed on a first suction opening side and a second slanted surface disposed on a second suction opening side, and the surface of the filter on the flat panel portion side having a convex shape that projects toward the flat panel portion, the surface of the filter on the flat panel portion side having a shape that slants continuously with respect to the heat exchanger.

2. The air conditioner of claim 1, wherein the suction opening further includes a third suction opening and a fourth suction opening that are disposed such that the flat panel portion is interposed therebetween in a direction orthogonal to the direction that interconnects the first suction opening and the second suction opening, and the surface of the filter on the flat panel portion side further includes a third slanted surface that is disposed on a third suction opening side and a fourth slanted surface that is disposed on a fourth suction opening side.

3. The air conditioner of claim 1, wherein the surface of the filter on the flat panel portion side includes a curved portion that is curved such that an intermediate portion of the curved portion projects toward the flat panel portion, the intermediate portion extending along a direction interconnecting the first suction opening side and the second suction opening side.

4. The air conditioner of claim 1, wherein the suction opening further includes a third suction opening, and a fourth suction opening, the first, second, third, and fourth suction openings being disposed separately in four directions of the flat panel portion, and the surface of the filter on the flat panel portion side includes a spherically shaped portion that projects toward the flat panel portion.

5. The air conditioner of claim 1, wherein the fitter has a convex or slanted surface projecting to the flat panel portion so that the thickness of the center part of the filter is thicker than other parts.

6. The air conditioner of claim 5, wherein the center part of the filter is disposed facing the air introduction opening.

7. An air conditioner comprising:

a casing having a flat panel portion disposed on a front surface, a suction opening having a first suction opening and a second opening which are disposed with the flat and portion in between and through which air that is taken in from indoors passes and a blowout opening through which air that is blown out to the indoors passes, the first suction opening being disposed on a the right side surface located on a right side of the flat panel portion, and the second suction opening being disposed on a left side surface located on a left side of the flat panel portion;

a filter being disposed facing the flat panel portion downstream of the suction opening and being configured to transmit air;

a heat exchanger being disposed facing the filter behind the filter and performing heat exchange with air that passes through the heat exchanger;

a centrifugal fan being disposed behind the heat exchanger a bellmouth having an air introduction opening that is disposed facing the heat exchanger behind the heat exchanger and that has an outer shape that is smaller than that of the heat exchanger when seen from the front, and being disposed between the heat exchanger and the centrifugal fan; and a blowout passage configured to guide air from the air introduction opening to the blowout opening, the centrifugal fan being configured to generate a flow of air that is sucked in from the suction opening and flows from a direction along a back of the flat panel portion toward the air introduction opening and passes through the filter, the heat exchanger and the air introduction opening and is blown out from the blowout opening, the filter having a thick portion disposed facing an edge portion of the air introduction opening, the thick portion having a thickness greater than that of another portion of the filter, with the thicknesses of the portions of the filter being measured along a direction perpendicular to a portion of the heat exchanger facing the filter.

* * * * *

UNITED STATES PATENT AND TRADEMARK OFFICE

CERTIFICATE OF CORRECTION

PATENT NO. : 8,356,659 B2
APPLICATION NO. : 12/159817
DATED : January 22, 2013
INVENTOR(S) : Zhiming Zheng et al.

It is certified that error appears in the above-identified patent and that said Letters Patent is hereby corrected as shown below:

Column 14,
Line 15, "and portion in between and through which air that is" should read -- panel portion in between and through which air that is --.

Signed and Sealed this
Twenty-sixth Day of March, 2013

Teresa Stanek Rea
*Acting Director of the United States Patent and Trademark Office*